US009995031B2

(12) United States Patent
Brown

(10) Patent No.: US 9,995,031 B2
(45) Date of Patent: Jun. 12, 2018

(54) ANTI-SPLASHBACK URINAL

(76) Inventor: Chad Brown, Fort Myers, FL (US)

( * ) Notice: Subject to any disclaimer, the term of this patent is extended or adjusted under 35 U.S.C. 154(b) by 1605 days.

(21) Appl. No.: 11/618,636

(22) Filed: Dec. 29, 2006

(65) Prior Publication Data

US 2007/0151011 A1 Jul. 5, 2007

(51) Int. Cl.

| | |
|---|---|
| ***E03D 13/00*** | (2006.01) |
| ***E03D 5/10*** | (2006.01) |
| ***E03D 9/05*** | (2006.01) |
| ***E03D 9/052*** | (2006.01) |

(52) U.S. Cl.

CPC ..... *E03D 13/00* (2013.01); *E03D 5/10* (2013.01); *E03D 9/05* (2013.01); *E03D 9/052* (2013.01)

(58) Field of Classification Search

USPC ..... 4/306, 309, 310; D23/302

See application file for complete search history.

(56) References Cited

U.S. PATENT DOCUMENTS

| | | | | | |
|---|---|---|---|---|---|
| 134,315 | A | * | 12/1872 | Robinson | 4/301 |
| 487,130 | A | * | 11/1892 | Schoen | 4/309 |
| 704,471 | A | | 7/1902 | Brown | |
| 1,114,670 | A | * | 10/1914 | Baker | 4/310 |
| 2,646,574 | A | | 7/1953 | Gillespie | 4/103 |
| 2,658,200 | A | * | 11/1953 | Bowers, Sr. | 2/8.1 |
| 5,027,448 | A | * | 7/1991 | Wilkins | 4/310 |
| 5,255,397 | A | | 10/1993 | Poole | 4/310 |
| 5,287,563 | A | | 2/1994 | Peters | 4/310 |
| 5,305,473 | A | | 4/1994 | Nakamura | 4/306 |
| 5,499,405 | A | | 3/1996 | Collins | |

(Continued)

FOREIGN PATENT DOCUMENTS

| | | | |
|---|---|---|---|
| CN | 2485360 Y | 4/2002 | E03D 13/00 |
| DE | 3347977 | 1/1986 | |

(Continued)

OTHER PUBLICATIONS

International Search Report and Written Opinion, dated Feb. 26, 2008.

(Continued)

*Primary Examiner* — Lauren Crane

(74) *Attorney, Agent, or Firm* — Hayes Soloway P.C.

(57) ABSTRACT

An anti-splashback urinal, comprising a bowl for receiving a user's urine, the bowl having a surface with a curvilinear shape designed to reduce the angle of impact between the urine and the surface and to carry the urine down and away from a user; an aperture, through which the user deposits the urine into the bowl, the aperture being off-center with respect to the bowl; and a drain that is offset aligned from the aperture. The urinal may also include a custom outer cover having a shape and color/pattern to complement the room. In a preferred embodiment of the invention, the urinal is equipped with a low flow flush system having an armature that dispenses water at a low flow rate. The armature preferably comprises a plumbing tubing bent into a shape complementary to said urinal, and equipped with misting nozzles. In a particular embodiment, the urinal further comprises an air filter, which optionally may be a water stripper, connected to an air exhaust system, wherein air from the urinal enters the air exhaust system through the air filter, and wherein the air exhaust system is connected to a fan.

38 Claims, 11 Drawing Sheets

(56) References Cited

U.S. PATENT DOCUMENTS

| | | | | |
|---|---|---|---|---|
| 5,575,020 | A | 11/1996 | Hubrig | |
| D377,972 | S * | 2/1997 | Kanai | D23/302 |
| 5,701,612 | A * | 12/1997 | Daneshvar | 4/144.3 |
| 5,727,263 | A | 3/1998 | Estrada | 4/216 |
| 5,806,107 | A | 9/1998 | Tilton et al. | 4/310 |
| 5,822,806 | A * | 10/1998 | Kizhnerman | 4/310 |
| 6,079,057 | A | 6/2000 | Mette | |
| 6,088,845 | A | 7/2000 | Estrada | 4/306 |
| 6,460,504 | B1 | 10/2002 | Neuo | |
| 6,470,504 | B1 * | 10/2002 | Neuo | 4/310 |
| 6,550,072 | B1 * | 4/2003 | Ware | 4/213 |
| 6,678,900 | B2 | 1/2004 | Ware | |
| 6,880,184 | B2 | 4/2005 | Vandersand | |
| 7,461,413 | B2 * | 12/2008 | Lewis et al. | 4/300.3 |

FOREIGN PATENT DOCUMENTS

| | | | |
|---|---|---|---|
| DE | 197 04 739 | 4/1998 | |
| DE | 199 22 274 | 11/2000 | |
| DE | 199 48 814 | 4/2001 | |
| GB | 2 364 635 | 2/2002 | |
| JO | 2004-353425 | 12/2004 | |
| JP | H2-305529 | 12/1990 | |
| JP | H02-118096 | 12/1991 | |
| JP | H03-118096 | 12/1991 | A47K 13/00 |
| JP | H5321311 | 12/1993 | |

OTHER PUBLICATIONS

Australian Official Action, Serial No. 2006339388 dated Apr. 12, 2011 (2 pgs).
Mexican Office Action, Appln. No. 8008650; dated Jun. 28, 2012 (3 pgs).
Mexico Official Action dated Jul. 19, 2011, with English translation, 8 pages.
Chinese Official Action + Translation issued in Chinese Patent Appln. Serial No. 200680050382.2 dated Jul. 12, 2011 (13 pgs).
Chinese Office Action issued in related application No. 200680050382.2 (w/English translation), dated Sep. 24, 2012 (19 pgs).
Australian Official Action, Serial No. 2006339388 dated Sep. 30, 2011 (2 pgs).
Chinese Official Action (with English translation) dated Apr. 14, 2010 in corresponding Chinese Appln Serial. No. 200680050382.2, (9 pgs).
Australian Official Action dated Nov. 14, 2011 in corresponding Australian Appln. Serial No. 2006339388 (2 pgs).
Dismissal of the Amendment and Decision of Refusal, issued in Japanese Patent Appln. Serial No. 2008-548876 dated May 8, 2012, with translation, 5 pgs.
Chinese Office Action, application No. 060850 376.2-1608 (w/English translation), dated Feb. 21, 2013, 4 pages.
European Search Report and Written Opinion dated Jun. 26, 2012 (8 pages).
Japanese Official Action with English translation, dated Jun. 22, 2011, Appln. No. 2008-548876 (6 pgs).
Australian Examiner's Report, Appln. No. 2006339388, dated Aug. 22, 2011 (2 pgs).
Chinese Official Action (with English translation) dated Feb. 17, 2012 in corresponding Chinese Appln Serial. No. 200680050382.2, (15 pgs).
Mexican Office Action w/ translation, dated Feb. 13, 2012 (4 pgs).
Mexican Office Action issued in corresponding Mexican Patent Appln. No. MX/a/2011/005887 dated Nov. 24, 2014 with English translation of relevant portions (5 pgs).
Japanese Official Action with English translation, Appln. No. 2008-548876 (7 pgs).
Australian Official Action, Serial No. 2006339388 dated Jan. 18, 2012 (2 pgs).
Brazilian Office Action issued in corresponding Brazilian Patent Appln. Serial No. PI0620898-4, dated Dec. 14, 2016, with English translation (10 pgs).
Mexican Office Action issued in corresponding Mexican Patent Appln. No. MX/a/2011/005887 (no translation) dated Jun. 1, 2015 (3 pgs).
Notice of Acceptance in corresponding Australian Patent Application Serial No. 2006339388, dated Feb. 8, 2012 (4 pages).
European Official Action in corresponding European Patent Application No. 06 850 376.2, dated Feb. 17, 2016 (5 pgs).
European Official Action in corresponding European Patent Application No. 06 850 376.2, dated Nov. 3, 2011 (4 pgs).
Notice of Allowance in corresponding Canadian Patent Application No. 2,674,336, dated Jun. 27, 2014 (1 pg).
Japanese Patent Decision (w/translation of relevant portions) in corresponding Japanese Patent Application No. 2008-548876, dated Dec. 4, 2012 (4 pgs).
Mexican Office Action (w/translation of relevant portions) in corresponding Mexican Patent Application No. MX/a/2008/008650 dated Mar. 23, 2011 (3 pgs).
Mexican Office Action (w/translation of relevant portions) in corresponding Mexican Patent Application No. MX/a/2011/005887, dated. May 26, 2015 (4 pgs).
Chinese Office Action issued in corresponding Chinese Patent Application Serial No. 200680050382.2 dated Jul. 2, 2013, with English translation, 20 pgs.
European Search Report, application No. 060850 376.2-1608 (w/English translation), dated Feb. 21, 2013, 4 pages.

* cited by examiner

ANTI-SPLASHBACK URINAL

REFERENCE TO RELATED APPLICATION

This application claims priority from U.S. Provisional Application Ser. No. 60/756,117, filed Jan. 3, 2006, and Ser. No. 60/793,689, filed Apr. 19, 2006.

BACKGROUND OF THE INVENTION

This invention relates generally to urinals and more particularly to wall and/or floor mounted urinals designed to minimize splashback, odor and water consumption. The invention also relates to urinals having custom covers having a shape and color/pattern to complement the room.

Mens' restrooms typically contain wall and/or floor mounted urinals. These urinals provide convenient access for male patrons to urinate. Additionally, these urinals save space and reduce the amount of water otherwise used by water closets.

A common problem with conventional urinals is the phenomenon known as splashback. Splashback occurs when droplets of urine are deflected back at the user due to the force of the user's stream of urine hitting a surface of the urinal. See FIG. 5*a*. This can cause offensive marks on the user's clothing as well as a health hazard. The force of flush water also can cause splashback to occur.

Another common problem with conventional urinals is that they often emit a foul odor. When the stream of urine contacts a surface of the urinal, some of the urine droplets will vaporize. Minimizing splashback will greatly reduce the amount of odor generated by a urinal and will alleviate health risks.

Also, conventional urinals typically consume a gallon or more of water per flush. While low water consumption urinals and water free urinals have been proposed and have enjoyed limited success, they still suffer from splashback, and often emit a foul odor.

Several inventions have been directed at correcting these problems. Innovations aimed at the splashback problem include a conical shaped urinal, a v-shaped urinal with an offset apex, and a urinal with splatter shields. See, for example, U.S. Pat. No. 5,027,448; U.S. Pat. No. 5,287,563; U.S. Pat. No. 5,806,107; U.S. Pat. No. 6,470,504. The drawback of these designs is that while the urine stream is deflected in a different direction, the amount of urine that becomes vaporized is still an odor and health problem.

Still other inventions have been aimed directly at treating the odor problem. These solutions include urinals with ventilation systems and urinals with drain traps. See, for example, U.S. Pat. No. 704,471; U.S. Pat. No. 2,646,574; U.S. Pat. No. 5,305,473; U.S. Pat. No. 6,088,845.

SUMMARY OF THE INVENTION

The present invention fills the need for a urinal with features that reduce splashback, vaporization, and other phenomena causing hygiene and odor problems. The present invention provides an anti-splashback urinal which comprises a bowl for receiving a user's urine, said bowl having a surface with a curvilinear shape designed to reduce the angle of impact between the urine and the surface and to carry the urine down and away from a user; an aperture, through which the user deposits the urine into said bowl, said aperture being off-center with respect to the bowl; and a drain having an alignment that is offset from said aperture.

The urinal may also include a custom cover having a shape and color/pattern to complement the room. In a preferred embodiment of the invention, the urinal is equipped with a low flow flush system that serves to reduce the amount of water and urine that is vaporized while simultaneously reducing the amount of water used per flush. In a preferred embodiment of the invention, the low flow flush system has an armature made of plumbing tubing that is bent into a shape that follows the shape of the bowl, in part. Nozzles disperse water or another liquid in the form of mist, spray, stream or other manifestation of fluid onto the surface of the bowl. The armature may be manufactured integral to the urinal or the bowl or may be made separately. The armature also may be adapted to fit conventional urinals.

In a particular embodiment, the urinal further comprises an air filter connected to an air exhaust system. Air from within and without the urinal enters the air exhaust system through the air filter. The air exhaust system is connected to a fan which may be activated manually, by motion sensors, or may be run continuously. Preferably, the air filter is a water stripper filter, designed to remove moisture from the air as it enters the air exhaust system.

BRIEF DESCRIPTION OF THE DRAWINGS

Further features and advantages of the invention will be seen from the following detailed description, taken in conjunction with the accompanying drawings, wherein.

DETAILED DESCRIPTION OF THE PREFERRED EMBODIMENTS

Figure 1:
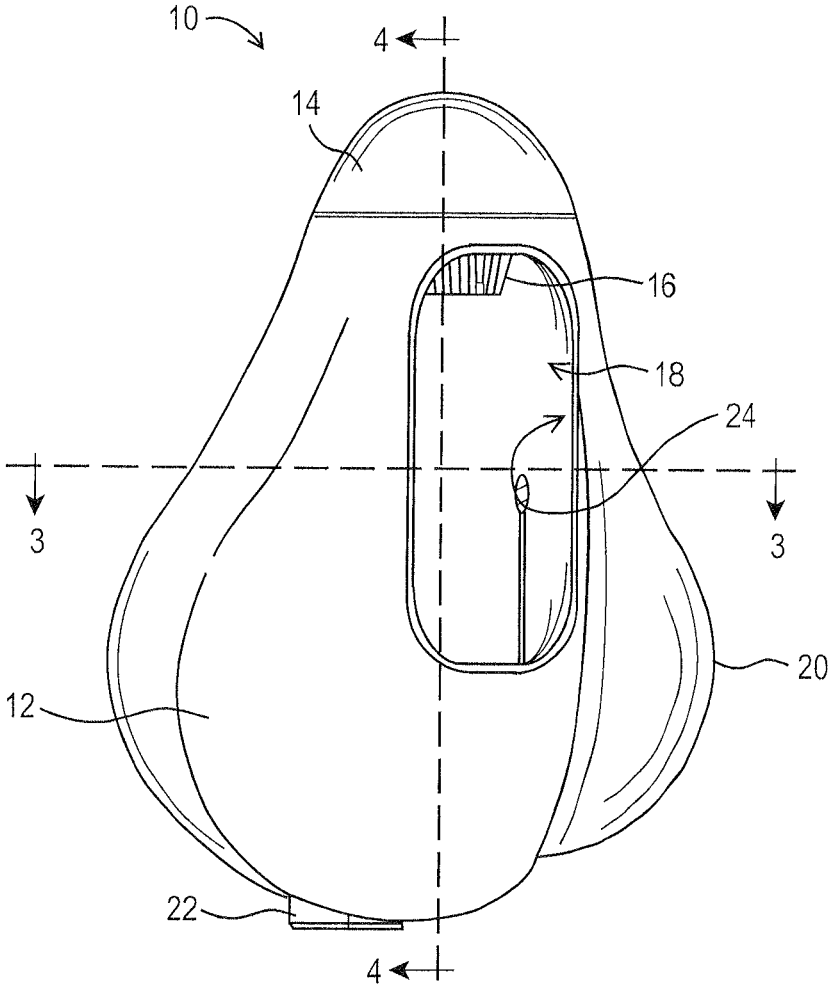
FIG. 1 is a front view.

The present invention provides a wall or floor mounted urinal designed to minimize or eliminate splashback, while maximizing containment and disposing of substantially all liquid, vapors and gases that enter into the urinal and/or are created within the urinal. And, unlike conventional urinals, the urinal of the present invention may be customized in terms of exterior aesthetic form, including, but not limited to form, color, texture and patterns.

Referring first to FIGS. 1-4, the anti-splashback urinal 10 in accordance with the present invention comprises a bowl 12, having an opening 18 for receiving urine. The bowl 12 includes an inner surface 24 which has an upwardly bowed curvilinear shape when viewed from a vertical cross-section, and an outwardly bowed curvilinear shape when viewed from a horizontal cross-section, designed to reduce the angle of impact of urine flow from the user i.e. from the perpendicular, so that when urine is streamed against the inner surface 24, the urine is directed inward and downward, away from the opening 18. Reducing the angle of impact reduces both splashback and vaporization. In a preferred embodiment of the invention the inner surface 24 has a generally epicycloid or heart-shaped or cardioid shaped contour. Preferably opening 18 is located toward one side of the bowl 12 such that the inner surface 24 of the bowl 12, including a drain 22 in a bottom portion of the bowl 12, is not aligned with the opening 18. With this configuration the urine stream will be directed down and away from the aperture 18 and thereby prevent splashback and vaporization. See FIG. 5*b*. Further, the shape of the bowl 12 and the limited access to the inner surface 24 by use of the aperture 18 provides for the ability to retain unpleasant odors and unhealthy vapors and gases within the inner portion of the bowl 12, defined by the shape of the inner surface 24, i.e., similar in function to a containment hood commonly found in chemical laboratories and the like.

Urinal 10 may be formed of any type of material that is impervious to fluids such as liquids and gases, the material including but not limited to ceramic, plastic, glass, and/or metal. The outer surface of the bowl 12 may be of any shape, while the inner surface should have a curvilinear shape as above described and may be independent of the shape of the outer surface. In a preferred embodiment of the invention urinal 10 is provided with an outer, non-functional cover 20 which may have a variety of shapes and colors/patterns to complement the room.

Figure 3:
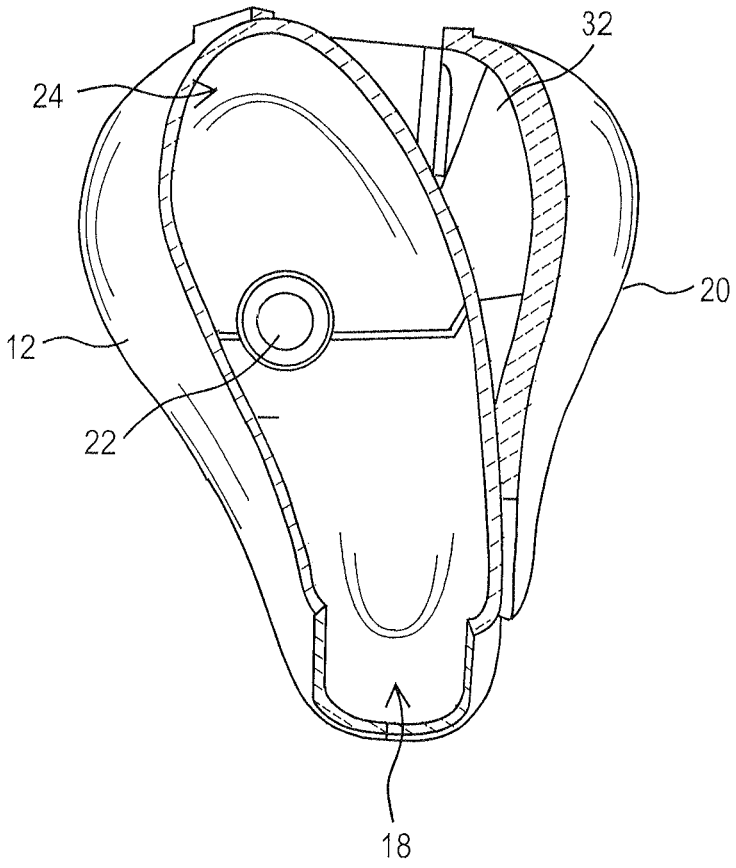
FIG. 3 is a section view of an anti-splashback urinal taken along line 3-3 of FIG. 1, in accordance with the present invention.

FIG. 3 shows a section view of the urinal in FIG. 1 taken along line 3-3. As can be seen from FIG. 3 and FIG. 5*b*, the shape of the bowl inner surface 24 directs the urine stream and prevents splashback and reduction of the vaporization and atomization associated with urination and flushing. As urine contacts the inner surface 24, the urine is diverted or directed in a direction away from the aperture 18 and toward the drain 22. Additionally, the shape allows the urine to better conform to the inner surface 24 and follow the surface toward the drain 22 rather than being deflected off of the inner surface 24 back toward a user. This reduction of deflection and the directing the urine away from the aperture 18 provides the resistance to splashback. Further, the shape of inner surface 24 provides for a more laminar flow rather than turbulent flow, thereby further reducing the vaporization and atomization associated with urination and flushing. The shape of the inner surface 24 may be of a variety of curvilinear shapes, but preferably is, a cardioid shape, in both the horizontal and vertical cross section. Further, while particular advantages result from locating the drain 22 offset from aperture 18, the drain may be located anywhere within the bowl 12 so long as the drain 22 functions to drain the liquids inside the urinal 10. Moreover, while the receiving aperture 18 is illustrated as generally rectilinear in shape with curved corners, the shape and size of the aperture is not limited to that shown, but may be of any size and shape to effectively allow access to the bowl 12 to deposit urine while minimizing splashback, foul odors, and unhealthy vapors and gases.

Figure 2:
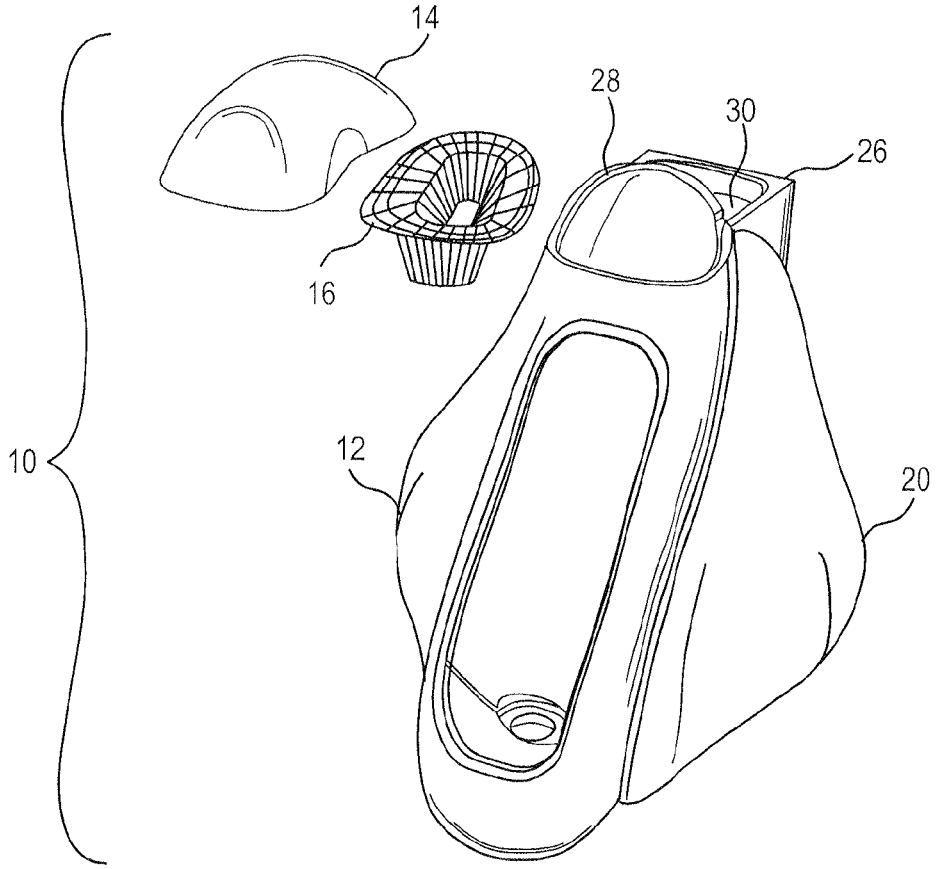
FIG. 2 a perspective exploded view of an anti-splashback urinal, in accordance with the present invention.

FIG. 2 depicts an exploded perspective view of an anti-splashback urinal 10 according to another embodiment of the present invention. The urinal 10 comprises a bowl 12, a cap 14, a filter 16 and a mount 26. The urinal 10 also has an aperture 28 configured to receive and retain the filter 16. The urinal 10 may also comprise aperture 30 through which air may freely travel. The apertures 28 and 30 may further be used to receive piping for flushing purposes and allowing fresh water to enter into the bowl 12 during flushing. The mount 26 provides a substantially planar surface, wherein the mount 26 enables the urinal 10 to be mounted substantially flush to a wall. While mount 26 may be used to mount the urinal 10 onto a wall, mount 26 may be extended to mount the urinal 10 onto the floor. The mount 26 also provides access to a back portion of the urinal 10. The filter 16 provides for the filtering of moisture from the air that may be evacuated through apertures 28 and 30. By way of example, during evacuation, the air may rise through aperture 28 and flow through aperture 30. The cap 14 may prevent air from escaping from the urinal 10 and further, may direct airflow from aperture 28 to aperture 30. As the air travels through aperture 28 and the filter 16, the filter 16 extracts moisture from the air and returns it to the inner surface 24 of the bowl 12.

Referring again to FIG. 3, the cover 20 also may have a void 32 that provides additional spaces that may be used to accommodate airflow and ventilation to the bowl 12. Alternatively, cover 20 may be a solid piece which may be used primarily for aesthetic purposes. Moreover, cover 20 is not limited to strict use with an anti-splashback urinal 10, of the present invention, but may be adapted for use on a conventional urinal that is wall and/or-floor mounted. In such case, the cover 20 may also provide a reduction of splashback, by covering, in part, the aperture of the conventional urinal so as to limit the opportunity for splashing. Cover 20 may be formed of materials which may be colored, painted and/or incorporate fabrics, wallpaper and/or any other material during the manufacture to provide a cover coordinating or contrasting with the colors and décor of the restroom in which the cover is to be used. For example, a fabric or wallpaper that complements the interior of the restroom may be laminated to the cover and protected by a clear coat.

Figure 4:
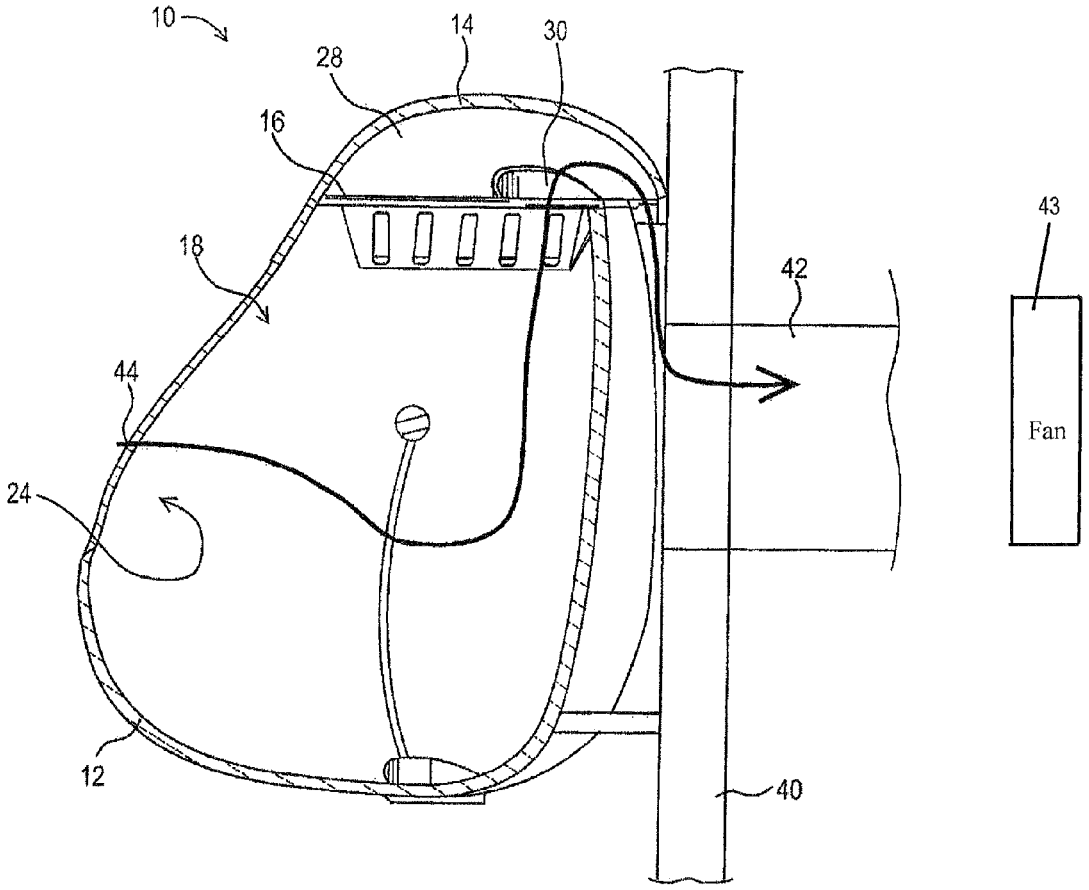
FIG. 4 is a section view of an anti-splashback urinal taken along line 4-4 of FIG. 1, in accordance with the present invention.
Figure 5A:
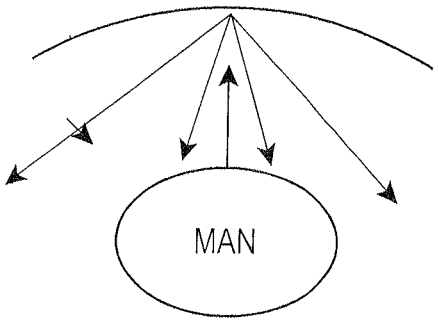
FIGS. 5*a* and 5*b* are top schematic views comprising a conventional urinal (FIG. 5A) and an anti-splashback urinal in accordance with the present invention (FIG. 5B)
Figure 5B:
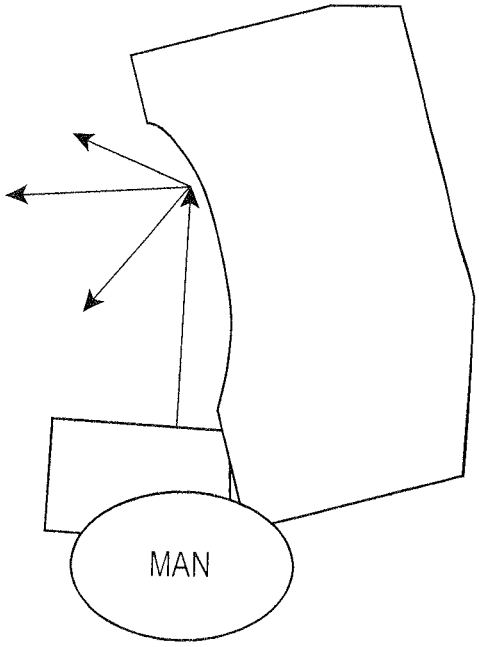

Referring in particular to FIG. 4, in a preferred embodiment of the invention, an exhaust system is coupled to the urinal 10, such that the urinal may be ventilated through the back portion of the urinal and exhausted through ducting located in the wall upon which the urinal 10 is mounted. In such embodiment, air may be drawn from a fan 43 located in the attic, ceiling and/or walls of the restroom or outside of the building, such as, on the roof. The fan 43 may also be located within the urinal 10, wherein the fan 43 draws air from the bowl 12 and exhausts the air out of the restroom. The fan 43 may be a conventional exhaust fan currently used in restroom applications. As the fan 43 runs, air is drawn from through the receiving aperture 18 into the bowl 12. The air follows airflow stream 44 through the inner surface 24 of the bowl 12, the filter 16, the aperture 28, and the aperture 30 and is exhausted through an opening in the mount 26 through ducting 42 located in a wall 40. This enables the evacuation of air that may carry foul odors, unhealthy vapors, and gases that are consistent with urine. Particular embodiments of the invention may evacuate air at a volumetric rate of, but not limited to, for example, 50 cubic feet per minute. This evacuation substantially eliminates any odor that may be emitted from the urinal 10. It will be understood that the rate of evacuation may be any volumetric rate that sufficiently removes the odors, vapors and gases within the bowl 12 as well as in air surrounding the urinal. Alternatively, air may be drawn from the bowl convectively.

The filter 16 may be used in the particular embodiments of the present invention that utilize an exhaust system. The filter 16 serves to stop moisture that may be in the air drawn through air stream 44 and return the moisture to the bowl 12. The filter 16 may be formed, for example, with layers of rigid material that contain offset holes. This offset of holes creates no straight lines of travel for the air through the filter 16, thereby improving the filtering ability of the filter 16. The vapor is filtered from the air and returned to the bowl 12. This helps to reduce the amount of moisture that may otherwise enter the ducting system, and further eliminates condensation that may form on parts of the urinal 10 located on the back portion only accessible through aperture 30 once the urinal 10 is mounted. This includes condensation of urine that would otherwise create sanitation problems on the back portion of the urinal 10. The filter 16 serves to prevent such sanitization problems and substantially prevents the formation of condensation in the back portion of the urinal 10.

The exhaust fan 43 may run continuously or intermittently, e.g. activated by a motion sensor that senses when a user approaches the urinal. The exhaust fan 43 may also be wired to run when the urinal is flushed.

Another feature and advantage of the present invention which results from the unique bowl design is the ability to operate with extremely low water consumption, i.e. a low-flow flush system. The low-flow flush system may utilize fresh water in both a liquid form and mist form. The flush system may be coupled to the urinal through an opening in the mount 26, wherein the apertures 28 and 30 are utilized to facilitate the flush system and/or though the drain 22, and wherein a portion of the drain 22 will be dedicated to allow water flow into the bowl 12 for flushing purposes. The flush system will utilize mist and liquid water to clean the inner surface 24 of the bowl 12 and to expel water and urine within the bowl through the drain. The low-flow flush system further provides for less vaporization of the urine held within the bowl 12. Vaporization is common during flushing of conventional urinals, wherein an amount of urine held will also be vaporized. Further, flushing of conventional urinals may also result in splashing of a water/urine mixture onto a user and/or into the surrounding area including the floor. These limitations of typical flushing systems of urinals are avoided with the low-flow flush system of particular embodiments of the present invention.

In one preferred embodiment of the invention there is utilized a mist flush system consisting of plumbing tubing (in one specific case ⅜" outer diameter copper tubing with ¼" inner diameter) that has been bent into a crescent shape with a height of approximately 7" from the drain to the tip of the misting armature and a radius of curvature that allows the crescent to follow along the inner wall of the bowl.

Figure 6A:
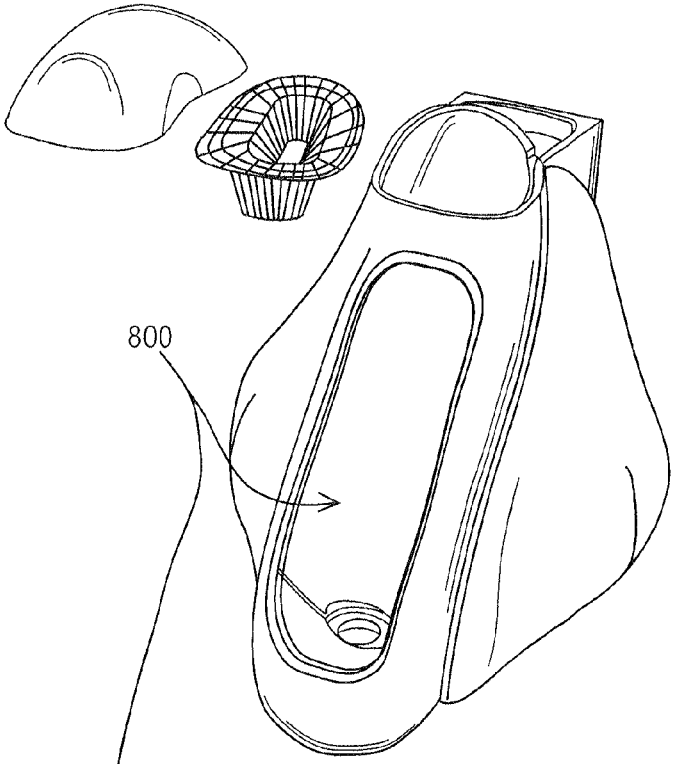
FIG. 6A is a perspective exploded view and FIG. 6B a section view of an anti-splashback urinal showing a crescent-shaped misting armature of the low flow flush system in accordance with one embodiment of the present invention.
Figure 6B:
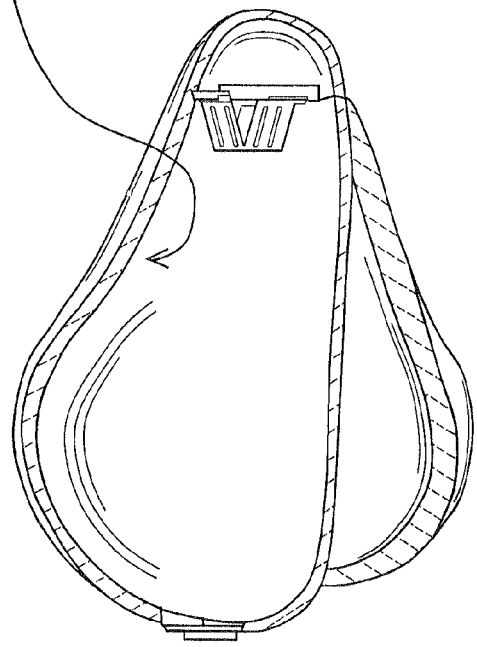
Figure 7:
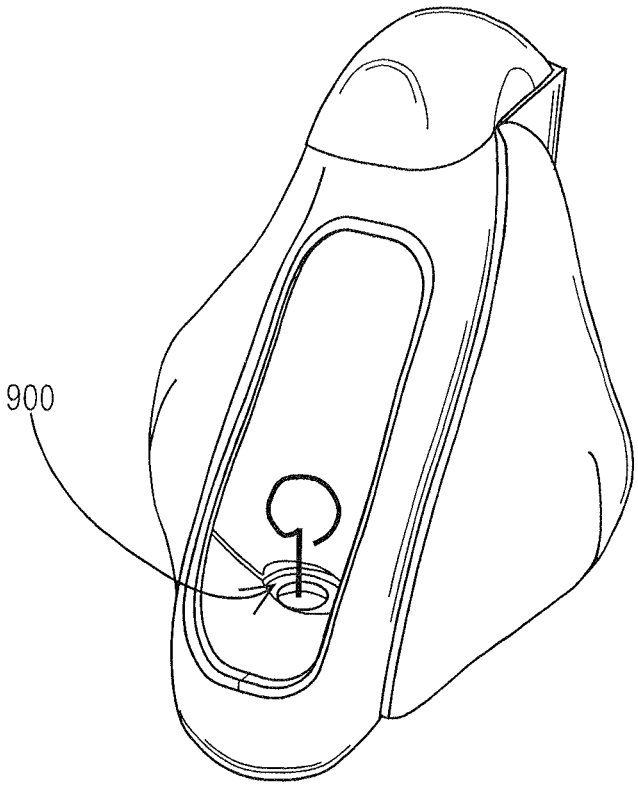
FIG. 7 is a perspective view of an anti-splashback urinal showing the configuration of the halo-shaped misting armature of the low flow flush system in accordance with another embodiment of the present invention.

Misting armatures have been tested in a variety of configurations, including a vertical crescent shape 800 (see FIGS. 6A and 6B) and a circular halo 900 (see FIG. 7) of various diameters from 3 to 12 inches. The armatures tested have included from 1 to 12 misting heads.

The misting systems may be integral to the body of the urinal or entirely separate from the urinal. A mister that is separate from a urinal may extend from within an area of the drain, or from the top, side or adjacent the front aperture of the urinal. The misting system may also pierce the inner bowl to release mist from within or toward the bowl. However, alternate locations may also be appropriate, including, but not limited to a top aperture, a front aperture, or puncturing an inner wall of the bowl at virtually any point. Furthermore, a misting system may be formed integral with the bowl walls themselves and fed via a manifold or other water feed external to the bowl. The water is expelled as a mist, spray and/or other liquid or vaporous forms through misting nozzles and/or spray heads that control the direction, velocity, flow rate and type of water (droplet, mist, stream, spray, fog, vapor, etc.) into the bowl. Other particular embodiments of misting systems include misting channels that encircle the front and or top apertures and direct mist into the bowl and away from exiting the front aperture.

Water droplet size may be varied with water pressure and modified/specialized misting nozzles. The smaller the size of the water droplets, the greater the surface area that may be covered for particular volume of water. Therefore, higher pressures of flush water and specialized misting heads will result in use of smaller volumes of water.

While the mist system is on (i.e. creating mist) the interior shape of the bowl and the orientation of the mist nozzles results in no mist exiting the bowl, regardless whether 1) a ventilation system is coupled to the urinal and activated or 2) not coupled to the urinal or not activated.

In testing, 37 minutes of mist flushing resulted in consumption of two quarts of flush water. The misting armature being tested was crescent shaped and expelled mist through 4 mist nozzles simultaneously. A target length of flush is under 3 minutes, which would consume less than one tenth of the water consumed in the aforementioned test. Therefore, water consumption would be less than one pint per flush.

Various misting nozzles are available commercially and advantageously may be used in the present invention, including, but are not limited to: 1) Brass Misting Nozzles, Mist & Cool, L.L.C., Simi Valley, Calif. 93065; "For pressures up to 250 PSI"; MClO3C: ½ to 1 Gallon Per Hour per mist head, 10-24 UNC thread; or 2) Raindrip, Tornado Fogger/Mister; 7 Gallons Per Hour per mist head; #162005; all plastic nozzles.

The brass misting nozzles from Mist & Cool L.L.C. result in much smaller mist droplets; thereby reducing the amount of water that is necessary to completely coat the interior of the bowl. Decreasing the size of the droplets results in higher total surface area of the water and therefore a lower total volume of water is needed to cover the same square area of urinal bowl surface. Thus, with higher water pressures even finer mist nozzles will result in smaller volumes of water turned into mist that will be sufficient to cover/coat/clean the same square area of urinal surface.

Mist systems may be used as the sole means for flushing urinals or in conjunction with liquid flush systems that utilize any other type of liquid, including: vapor, fog, spray, stream, atomized, etc.

Water pressure boosting devices, and air compressors used in conjunction with plumbing systems, may be utilized to further increase water pressure to result in finer mists (smaller water droplets) being used in misting systems to further lower the water consumption of a urinal.

Another embodiment of the invention involves the use of a water stripper as an air filter. The water stripper in accordance with the present invention filters and/or strips fluids including, but not limited to water, liquid, mist, vapor, fog, humidity and the like from the air that is being evacuated from the bowl of the urinal and/or the air surrounding the urinal.

Figure 8A:
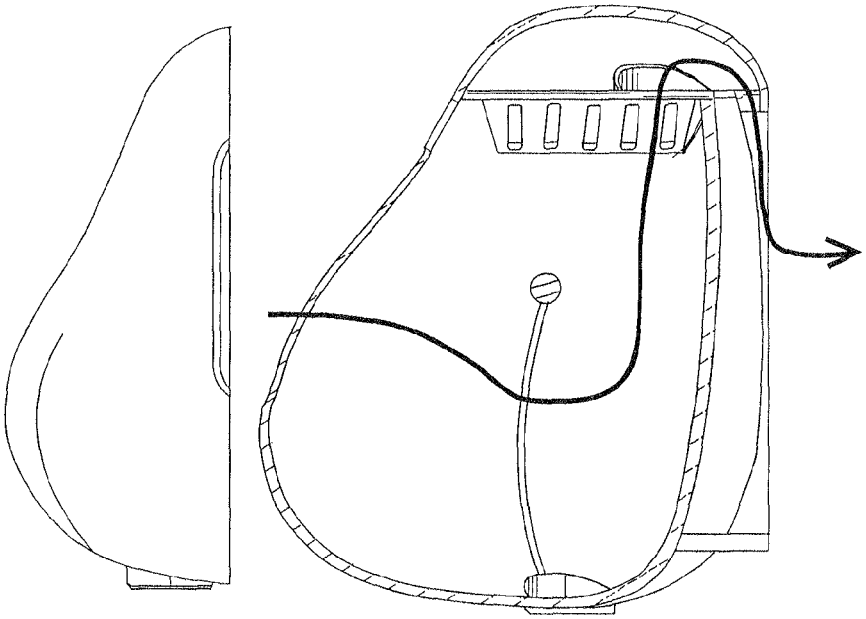
FIGS. 8A, 8B, 8C, and 8D are views of an anti-splashback urinal showing the airflow path in accordance with yet another embodiment of the present invention.
Figure 8B:
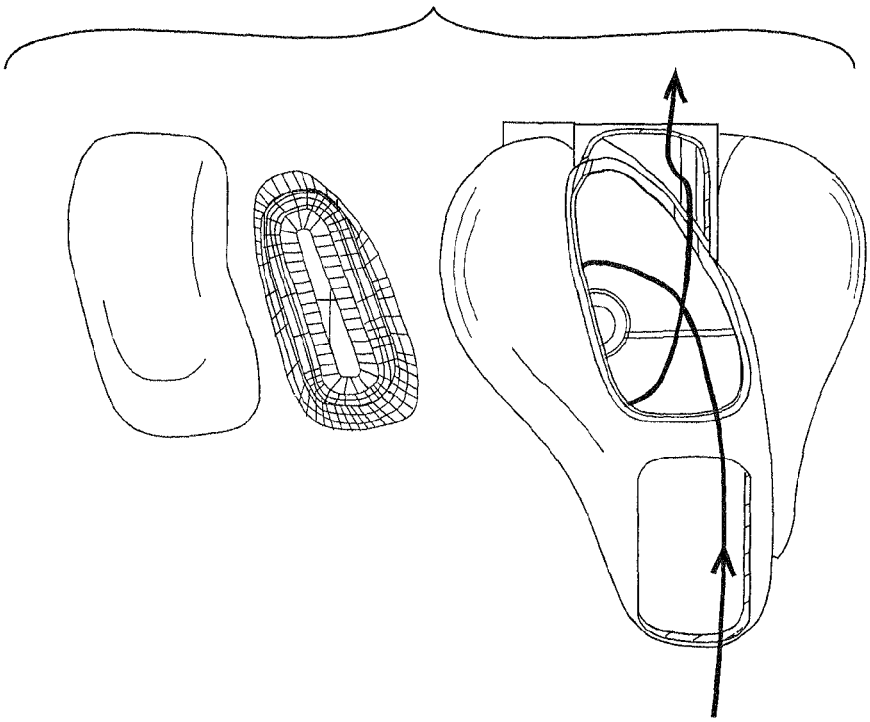
Figure 8C:
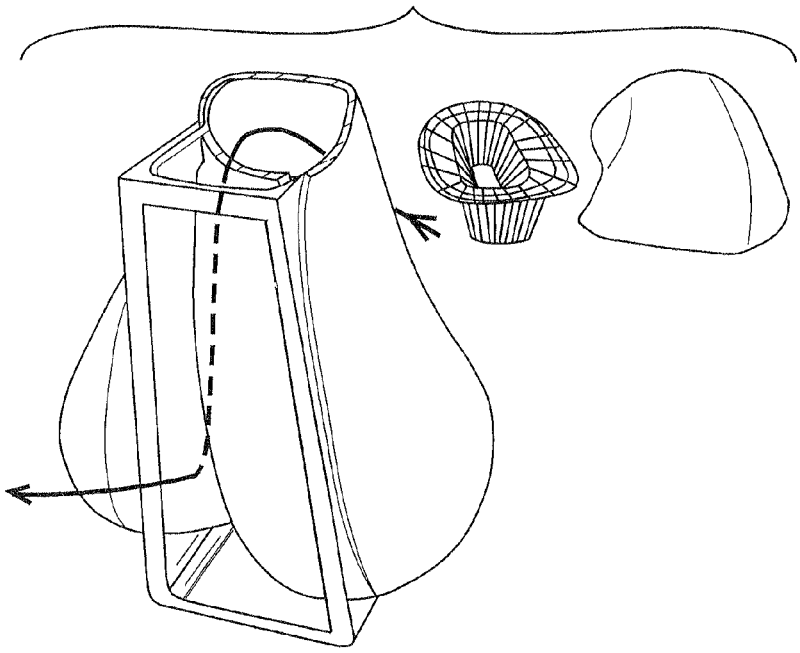
Figure 8D:
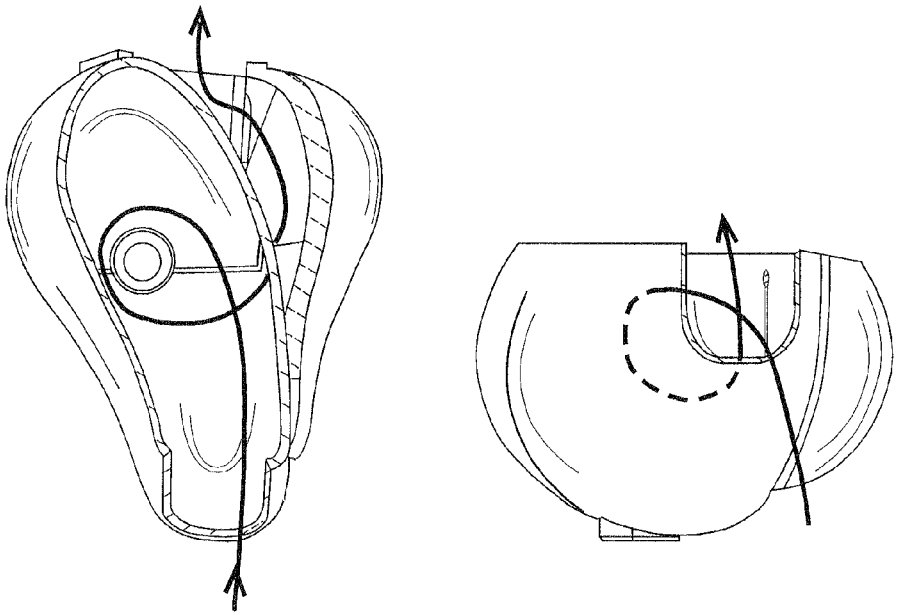

The water stripper for the urinal may be placed anywhere along the pathway of air that is being evacuated from the interior of the bowl. In one embodiment, the stripper is fitted to fill the entire top orifice of the bowl (see FIGS. 8A and 8B), such that no air may bypass it, and all air must travel through it, as the air is pulled, by the ventilation system, out of the bowl and into the ducts within the wall that the urinal is mounted on, or alternately, the ducts external to the urinal (see FIGS. 8C and 8D), through which air is being evacuated from the urinal or from elsewhere in the restroom.

Without being bound by theory, it is believed that the water stripper acts on the principle of conservation of momentum. As such, liquid of any sort (mist, vapor, atomized liquid, fog, humidity, droplets and stream) that may be entrained in the air stream passing through the water stripper has a greater momentum than the air itself, due significantly to its greater mass than the air. Since the air passing through the stripper is forced to change directions abruptly due to the shape of the pathways through the stripper, the entrained liquid of any sort cannot change direction as quickly as the air; and therefore, the liquid (of any sort) impinges upon and adheres to the solid surfaces of the stripper and thereby leaves the air stream that had carried it there.

After the liquid impinges on the surfaces of the stripper, the air is therefore less humid (carries less liquid) and travels on through the air ventilation system. The liquid that impinges on the surfaces of the stripper condenses and gathers in growing quantity (droplets) on the stripper surfaces, as more and more liquid impinges on the same surfaces. The resulting and continued impingement and collection of liquid of any kind (including but not limited to vapor, mist, droplets, stream, atomization of urine, etc.) on the stripper continues until either: 1) the droplets grow so large that gravity pulls them off of their attached surface and back toward and into the bowl; or, 2) the droplets do not continue to grow, but instead slowly evaporate back into the air stream traveling past them, as the air within that stream becomes less humid and essentially dries the surfaces of the stripper. The airstream's humidity may be reduced substantially when the mist system is operating, and the vast majority of the fresh water that is meant to clean the bowl, actually does so by dripping back into the bowl and down the drain.

Figure 9:
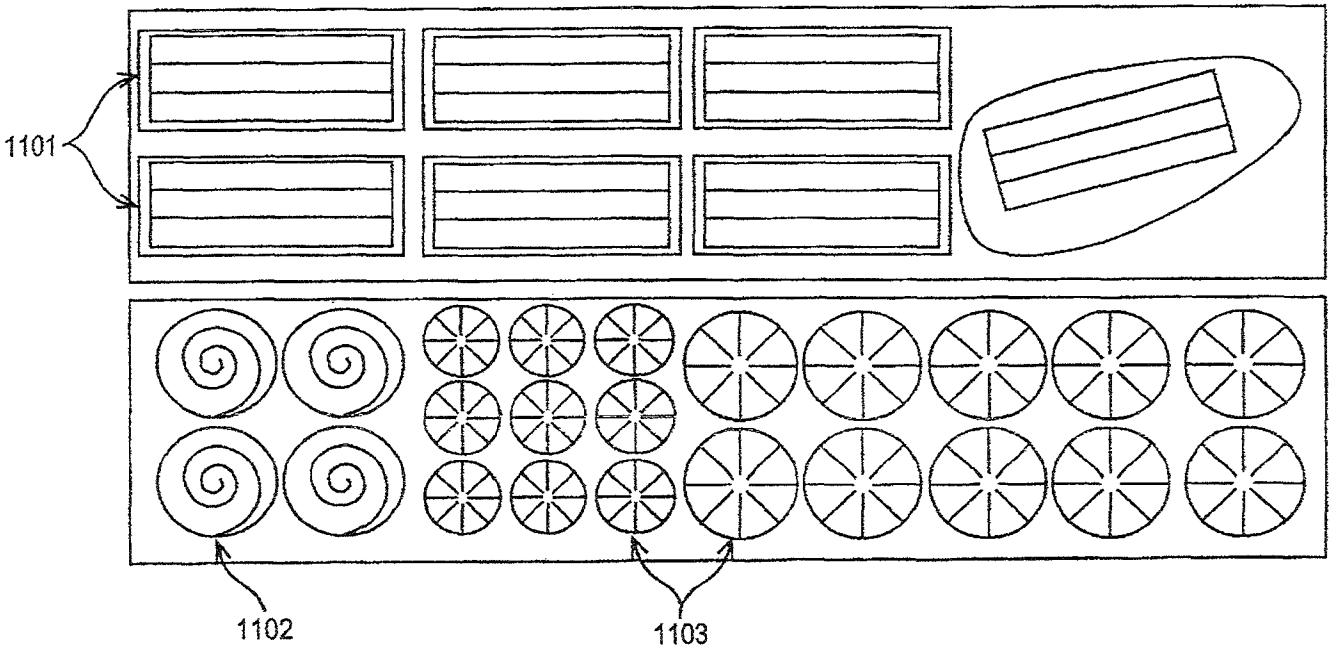
FIG. 9 illustrates various exemplary geometries of water strippers useful in accordance with the present invention.
Figure 10A:
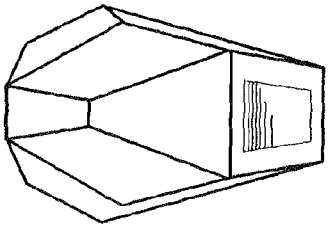
FIGS. 10A, 10B, and 10C and 11A, 11B and 11C are top, side and front views, respectively, of urinal covers in accordance with the present invention.
Figure 10B:
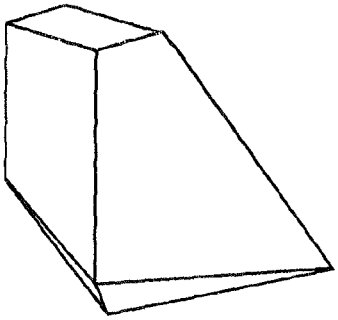
Figure 10C:
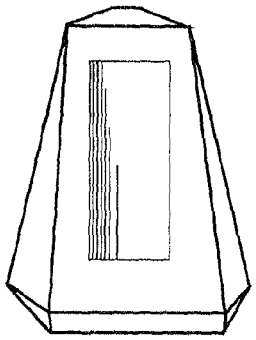
Figure 11A:
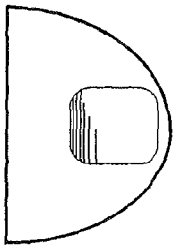
Figure 11B:
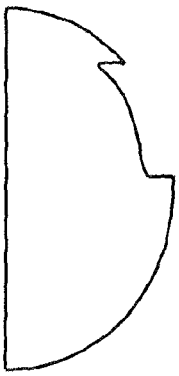
Figure 11C:
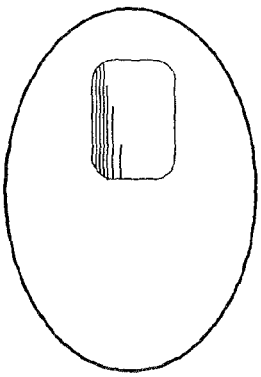

Any of a wide variety of water strippers for urinals may be embodied by this invention. As illustrated by FIG. 9, this variety of water strippers may include, but is not limited to, parallel surface plates with parallel slats 1101, offset holes of circular and other shapes, extruded spirals 1102 and layers appearing like stacked sets of fan blades 1103. The water strippers generally direct the air to change speed (by increasing or decreasing the cross-sectional area of the path of travel for the air) and/or they change the direction of the air flow abruptly such that there is no straight path for the air to travel, but rather a zig-zag path, such that entrained liquids are introduced to surfaces on which to impinge and adhere. FIG. 9 illustrates in 2-D how rigid material may be cut such that it will provide such directional and velocity changes in flow within such water strippers.

In use, the mist flush water coats the entire interior surface of the bowl evenly. The interior shape of the bowl and the orientation of the mist nozzles, as well as the orientation and direction of the air being sucked into the top orifice of the urinal via the ventilation system may create a vortex of air within the bowl that facilitates even coating of mist throughout the urinal bowl as well as complete containment of the mist within the bowl.

The interior shape of the bowl also promotes a vortex for gaseous and liquid flows within it. This vortex effect has multiple utilities, including, but not limited to: 1) reduction of turbulence and increased laminar flow of urine (or other liquid streams) entering into the bowl from the front aperture (such reduction of turbulence reduces splashback and reduced vaporization, atomization and evaporation that otherwise lead to odors; 2) reduction of turbulence and increased laminar flow of flush water passing over the walls of the bowl; 3) even distribution of the flush system mist across the inner walls of the bowl; 4) eddies of air are created along the front aperture such that mist is impeded from exiting the bowl of the urinal; and, 5) the vortex also serves to fling the mist droplets against the sides of the bowl before they are sucked up through the mist stripper in the top aperture of the bowl.

The interior shape of the bowl, the orientation of the mist nozzles and the flow of air being pulled into the front aperture and eventually out the top aperture of the bowl (through the water stripper) all work synergistically to create a vortex that reduces odor, splashback, and water consumption.

Eddies may be produced around the front aperture that result in at least two benefits: 1) it draws the mist that is being produced within the bowl, along the interior walls of the bowl, even opposite to the travel of the main flow of air into the bowl through the front aperture, thereby fully, completely and evenly coating the walls of the urinal all the way up to the front aperture, and, 2) it keeps the mist subdued and contained within the interior of the bowl, without letting any escape from the bowl through the front aperture.

Even without an operable ventilation system coupled to a urinal, mist itself reduces, subdues, sequesters and removes odors from air. Therefore, even without a ventilation system either present or working, the urinal's mist system will substantially reduce and/or eliminate odors within the bowl of the urinal that would otherwise escape into and pollute the surrounding restroom and attached facilities.

The ventilation system also pulls air into the bowl from outside of the urinal and thus may further reduce odors in the restroom.

Various changes may be made not departing from the spirit and scope of the invention. For example, the non-functional cover 20 may be formed as a separate element sized and shaped to fit on a conventional urinal. The cover may comprise a non-functional skin, sheath or other rigid or flexible material which may include flexible, adhesive backed panels or fabrics for mounting directly onto an existing urinal, or, as shown in FIGS. 10A-10C and 11A-11C, the cover may be formed of rigid or shaped panels, or molded construction. Thus, one can update the look of an installed urinal for example, in a remodel. Also, the air filter/water stripper may be incorporated into a conventional bathroom air exhaust system.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the present invention.

What is claimed is:

1. A urinal, comprising:

a bowl for receiving a stream of an user's urine, said bowl having an inner back wall surface having an upwardly bowed continuous curvilinear shape when viewed from a vertical cross-section and an outwardly bowed continuous curvilinear shape when viewed from a horizontal cross-section, said inner back wall surface continuous curvilinear shape functioning to reduce an angle of impact between the stream of urine and the inner surface to contain urine spray in three dimensions, and carry the urine down and away from the user;

a permanently open aperture, through which the user deposits the urine into said howl;

a drain through a bottom of the bowl; and further comprising an air filter.

2. A urinal according to claim 1, wherein the drain and the aperture are offset aligned with respect to the user.

3. A urinal according to claim 1, further comprising removable cap above the aperture, providing access to said filter.

4. A urinal according to claim 1, wherein the urinal is mounted to a wall or floor.

5. A urinal, comprising:

a bowl for receiving a stream of an user's urine, said bowl having an inner back wall surface having an upwardly bowed continuous curvilinear shape when viewed from a vertical cross-section and an outwardly bowed continuous curvilinear shape when viewed from a horizontal cross-section, said inner back wall surface continuous curvilinear shape functioning to reduce an angle of impact between the stream of urine and the inner surface to contain urine spray in three dimensions, and carry the urine down and away from the user;

a permanently open aperture, through which the user deposits the urine into said bowl, said aperture being off-center aligned with respect to the bowl;

a drain through a bottom of the bowl that is offset aligned with respect to said aperture, wherein the urinal is mounted to a wall or floor;

a cover comprising a shaped body which covers at least a portion of the urinal, without blocking access to the bowl; and further comprising an air filter and an air exhaust system, wherein air from the urinal enters the air exhaust system through the air filter.

6. A urinal according to claim 5, wherein the air exhaust system is connected to a fan.

7. A urinal according to claim 6, wherein the air exhaust system gathers air from within and surrounding the urinal.

8. A urinal according to claim 6, wherein the fan is powered continuously.

9. A urinal according to claim 6, wherein the fan is powered upon activation of a motion sensor.

10. A urinal according to claim 6, wherein the fan is powered upon user input.

11. A urinal according to claim 5, wherein said cover is formed integral with the bowl.

12. A urinal according to claim 5, wherein the cover is formed separately from the bowl.

13. The urinal of claim 1, further comprising an aesthetic cover.

14. The urinal of claim 1, wherein the inner surface has a generally epicycloid or heart-shaped or cardioid shaped contour.

15. A urinal according to claim 13, wherein said cover is formed integral with the bowl.

16. A urinal according to claim 13, wherein the cover is formed separately from the bowl.

17. The urinal of claim 5, wherein the inner surface has a generally epicycloid or heart-shaped or cardioid shaped contour.

18. The urinal according to claim 1, wherein the shape of the inner back wall surface of the bowl is a cardioid in shape.

19. The urinal according to claim 1, further comprising an armature for providing flush water to a urinal, wherein said armature is comprised of tubing that is bent into a shape complementary to an inner surface of said urinal, said tubing having misting nozzles.

20. The urinal according to claim 19, wherein the tubing is fed into the urinal through a drainpipe.

21. The urinal according to claim 19, wherein the tubing is fed into the urinal through a top of the urinal.

22. The urinal according to claim 19, wherein the armature is crescent-shaped.

23. The urinal according to claim 19, wherein the armature is halo-shaped.

24. The urinal according to claim 19, wherein the armature is crescent-shaped.

25. The urinal according to claim 19, wherein the armature is halo-shaped.

26. The urinal according to claim 5, further comprising a low flow flush system having an armature that dispenses water into the urinal, said armature comprising tubing bent into a shape complementary to an inner surface of said urinal, said tubing having misting nozzles.

27. The urinal according to claim 26, wherein the armature is crescent-shaped.

28. The urinal according to claim 26, wherein the armature is halo-shaped.

29. The urinal according to claim 26, wherein the tubing is fed into the urinal through a drainpipe.

30. The urinal according to claim 26, wherein the tubing is fed into the urinal through a top of the urinal.

31. The urinal according to claim 1, further comprising a booster for increasing pressure of the water supplied to system.

32. The urinal according to claim 5, further comprising a booster for increasing the water pressure of water supplied to the system.

33. The urinal according to claim 1, wherein the air filter comprises at least one water stripper, wherein air traveling through the air exhaust system is pulled through said at least one water stripper.

34. The urinal according to claim 5, wherein the air filter comprises at least one water stripper, wherein air traveling through the air exhaust system is pulled through said at least one water stripper.

35. The urinal according to claim 1, wherein the said at least one water stripper has a geometric shape selected from the group consisting of parallel surfaces with parallel slats, offset holes, extruded spirals, and layers of stacked sets of blades.

36. The urinal according to claim 5, wherein the said at least one water stripper has a geometric shape selected from the group consisting of parallel surfaces with parallel slats, offset holes, extruded spirals, and layers of stacked sets of blades.

37. A urinal according to claim 1, further comprising removable cap above the aperture, providing access to said filter.

38. A urinal according to claim 5, further comprising removable cap above the aperture, providing access to said filter.

* * * * *